United States Patent [19]

Nakatsu

[11] Patent Number: 4,721,334

[45] Date of Patent: Jan. 26, 1988

[54] APPARATUS FOR ASSISTING IN THE USE OF CHOPSTICKS AND METHOD FOR MAKING SAME

[76] Inventor: Daniel T. Nakatsu, 117 Westwood Dr., San Francisco, Calif. 94112

[21] Appl. No.: 849,179

[22] Filed: Apr. 7, 1986

[51] Int. Cl.[4] ..... A47G 21/10; A47J 43/28

[52] U.S. Cl. ..... 294/99.2

[58] Field of Search ..... 294/99.2, 99.1, 16, 294/3, 8.5, 11, 33; 24/499, 500, 501, 511, 530; D7/165

[56] References Cited

U.S. PATENT DOCUMENTS 3,186,749 6/1965 Dawes ..... 294/99.2

3,637,248 1/1972 Arita ..... 294/99.2

*Primary Examiner*—James B. Marbert

*Attorney, Agent, or Firm*—H. Michael Brucker

[57] ABSTRACT

A device for assisting in the use of chopsticks and a method of making same characterized by a band spring of single-piece, molded or formed construction, free of separate and joined members, to connect a pair of chopsticks at an adjustable distance from each other and enable their manipulation in a manner substantially identical and faithful to the proper holding and wielding of a pair of individual and unjoined chopsticks. The spring's structure consists of a curved and bent band spring extending between and terminating in two sleeves with adjustable apertures through which the chopsticks are passed. Forward disposition of one sleeve relative to the other sleeve causes one chopstick to have an axial component of movement when pressed toward the other chopstick. The sleeves are self-securing in their attachment to the chopsticks and can accommodate chopsticks of varying size. The distal space between the chopsticks can be altered to adjust the spring for holding by hands of differing size.

11 Claims, 9 Drawing Figures

APPARATUS FOR ASSISTING IN THE USE OF CHOPSTICKS AND METHOD FOR MAKING SAME

BACKGROUND OF INVENTION

Chopsticks are the age-old universal and principal eating implement of the Far East, namely Japan, China, North and South Koreas. They are also used as a cooking utensil for sorting, mixing, and lifting ingredients. While they are predominantly made of wood or plastic, some esoteric ones are made of silver or ivory. They vary greatly in their length, thickness, tapering and cosmetics within countries and between countries.

True, efficient utilization of chopsticks requires that they be correctly held and manipulated in order to be used effortlessly, skillfully and effectively. Varying etiquettes and traditions relating to chopsticks have evolved over the ages in each country, but the manner of holding and manipulating them is universally and fundamentally the same.

To untrained or unaccustomed hands, in truth, however, the proper holding and manipulation of chopsticks can be a difficult, awkward or even formidable task. Various prior art devices have, especially in the last three decades, attempted to lessen this difficulty or aid untrained hands to use them. For the most part, the prior art devices have relied on a prong, tong, or pincer-like assembly of two elongated members connected, fastened or crossed at a certain pivotal location with a joined contact or a certain distal space between the members at the point of connection, creating a fulcrum(s) which allows the members to be pivoted and their front ends converged to grasp small objects.

While in purpose they are intended to provide an assembly that substitutes for or simulates the converging and grasping mechanism of properly wielded chopsticks, none virtually none of them achieve this result because they do not faithfully conform to the actual anatomy and mechanics of chopstick holding and manipulation.

Chopsticks are basically held with a first or lower stick resting in fixed or immobile position in the crotch between thumb and forefinger, and also against the side of the fourth finger at or just ahead of its first joint, and held there by pressure from the trunk of the thumb. The second or upper stick is, in turn, held by the tactile tips of the thumb and forefinger against the side of the middle finger in a pencil-holding grip. At first glance the confluence of these three appendages appears to provide a single or primary fulcrum for simply pivoting the upper stick merely up and down. But in reality the anatomy and mechanics involved in manipulating the upper stick are much more complex.

There are at least three other functionally important fulcrums located at the bases of the thumb, forefinger and middle finger. Each of these is a rotative joint which allows the appendage to be pivoted in various directions. In proper chopstick manipulation, the thumb's base joint functions to pivot the thumb sideways as well as inward toward the palm. In contrast, the forefinger and middle finger pivot and bend essentially in one direction, toward the palm. It is the combination of these three fulcrums functioning together, rather than the seeming and assumed principal or primary fulcrum at the confluence of the three appendages, that enables the upper stick to be depressed and descend, urged downward by the forefinger in concert with the middle finger and thumb.

Close observation reveals that due to the multijointed curvature, bending and flexing of the forefinger and middle finger, when the upper stick is urged downwardly by them to firmly contact the lower chopstick, the upper stick not only descends but distinctly moves forward along its own axis and its end will extend slightly beyond that of the lower stick upon contact.

This can be readily demonstrated and observed by, first, properly gripping a pair of chopsticks with the sticks approximately parallel to each other and pressing the forward ends against a flat surface such as table top perpendicular to the surface, to align the ends with each other. Then, second, by holding up the chopsticks horizontally and, next, depressing the upper one to contact the lower one.

If this is done in natural manner without deliberately and consciously attempting to compel the ends to stay aligned with each other when converged, one will find that the upper stick has moved forward (along its axis) in its descent, and its point now extends slightly beyond the lower stick's point at the convergence. This is especially true as pressure is applied to the upper stick as it contacts the other stick, or a small object about to be held by them. The pressure and resistance inherent in the contact produce a tension that urges the middle finger and forefinger to slightly flex forward, thus helping to place the upper stick ahead of the lower one. This invariably happens naturally in manipulating chopsticks, and it does not diminish their effectiveness. Objects are mostly approached by chopsticks at an oblique angle to begin with, and it does not matter that the upper stick is nominally disposed slightly ahead of the lower one upon contact with the object.

It is pertinent to note, however, that during the course of a meal practised users of chopsticks are often observed to press the points against a plate or the table top to realign them from time to time. This is because the ends do tend to become misaligned in continual use due to the forward inclination of the upper member. If not realigned from time to time, the upper member could progressively become disposed so far forward that convergence and grasping of objects would be impaired. This observable common behavior of practised users to realign the points of their chopsticks attests to the occurrence of forward axial movement of the upper stick when chopsticks are properly held and manipulated.

The use of chopsticks with a mechanism designed to assist in their use but which resists axial movement results in a noticeable, confining stiffness in converging the two members. Converge they will, but not in the natural manner of properly manipulated chopsticks, and prolonged use will predictably and rapidly cramp and tire the fingers.

The only known prior art device designed to assist in the use of chopsticks which provides for sufficient axial movement of the upper chopstick so as to accurately simulate the use of chopsticks without aid is disclosed in Japanese patent No. 36-16887, issued June 26, 1961 to Matsuya Department Store. The present invention represents a substantial improvement to the said device in that it teaches the fabrication of the spring and chopstick-securing means from a single blank of material without requiring any fasteners or connecting means to attach the various parts of the assembly. In addition, the present invention teaches a new and different structural formation by which the chopsticks are automatically secured to the working spring band and whereby chopsticks of differing dimensions are flexible and readily received and secured without the requirement for affixing together any two separate parts of the assembly or spring unit with fasteners or other similar means. By virtue of the improvements taught by the present invention, an integral, effective and inexpensive device for aiding in the use of chopsticks can be efficiently manufactured using known techniques requiring only the molding and bending of various parts of a single blank of material.

SUMMARY OF THE INVENTION

The present invention comprises spring means including attachment means disposed to connect a pair of chopsticks at a selected distance from each other whereby compression and extension of the spring results in manipulation of the chopsticks in a manner faithful to the holding and wielding of regular, unjoined chopsticks. In addition, the spring means is detachable from the chopsticks and accommodates chopsticks of varying size. It is, additionally, self-securing in its attachment to the chopsticks and adjustable to hands of different sizes. Further, the invention teaches a method of forming the spring means and attachment means from a single piece of material.

In the preferred embodiment the spring means comprises a curved band of resilient material (e.g. brass sheet metal) with two prominent bends in it, extending between and terminating in identical upper and lower sleeves which are each comprised of two concavely folded and overlapped flanges with rounded corners forming a tunnel aperture for receiving a chopstick. The flanges are reasonably tractable in their overlapped formation, making the sleeve's girth adjustable. This adjustability enables the spring unit to be fully detachable from the chopsticks and also accommodate chopsticks of varying thickness or girth.

Within each sleeve, the band spring's traversing direction is reversed by a small full loop at the terminus immediately outside the sleeve. The band spring extends from the loop at an angle in the sleeve before exiting from the other end of the sleeve. Friction and pressure tension occur in the chopstick's contact with the loop outside the sleeve and with the angled, biased band spring within, effectively and automatically securing the sleeve to the chopstick in concert with the constricting, overlapped flanges which define the sleeve.

Upon exiting from the upper sleeve, the band spring is roundly bent downward at an obtuse angle close to the sleeve. It then extends in a slight arc to the level of the lower sleeve where it is roundly bent at an acute angle near and toward the end of the lower sleeve, and further extends into that sleeve. It terminates in a small, full loop outside the other end of the lower sleeve in a formation identical to the structure of its terminus in the first or upper sleeve.

The angles of the two bends in the band spring between the sleeves and the locations of the bends result in a configuration of installed chopsticks and spring that resembles one-half of a parallelogram. Further, these angles and locations in relation to the parallel sleeves result in the first sleeve being disposed significantly forward relative to the other sleeve. This forms a biased arrangement that induces a natural forward implement when a chopstick in the first sleeve is urged downward toward a chopstick in the other sleeve consistent with and substantially identical to the forward-leaning descent of the moveable upper stick in a pair of normal, unconnected chopsticks which are correctly held and manipulated.

Due to the two prominent bends, and especially the lower one, being capable of contraction or expansion by gently pulling apart or pushing together the installed chopsticks, the distal space between the sticks is changeable. The height of the assembly, therefore, can be adapted and modified, if necessary or desired, for holding by hands which are pronouncedly different in size.

When such modification is made, it is necessary that the approximately parallel arrangement of the chopsticks be retained, and the upper stick is moved forward or backward to keep its forward end in alignment with that of the other stick. This modifying adjustment is simple to make, and upon completion will not negatively affect the assembly's intended function, so long as the first or upper sleeve remains forward of the other, lower sleeve.

DRAWINGS AND DESCRIPTION

The characteristics, structure, function and advantages of the invention are evident in the ensuing drawings and descriptions, wherein.

Figure 1:
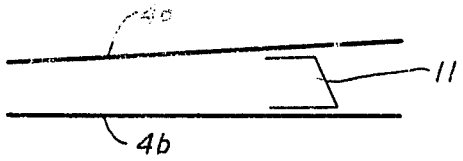
FIG. 1 is a schematic view of the spring of the present invention when attached to chopsticks.

The present invention, unlike prior art devices, provides spring means which facilitates and abets, rather than resists and obstructs, the forward axial movement of the upper chopstick. Referring to FIG. 1, spring means 11 shown schematically, is characterized by an oblique, slanted configuration, with the attachment to a first or upper member **4*a* deployed forward in relation to the attachment to the other or lower member 4*b*. When the upper member 4*a* is urged toward lower member 4*b* against the restraint of the spring, upper member 4*a*** is free to move slightly and naturally forward along its axis as the hand wants it to do.

Referring to FIGS. 2A, 2B, 2C and 2D, a preferred embodiment of the chopstick-assisting device of the present invention is formed from a flat one-piece blank 12 of resilient material shaped in the form of an "H" having transverse end members 13 symmetrical about the axis 14 of a center connecting band member. The end members 13 comprise roundly cornered flanges 15 extending from the center band 16 which is contiguous with the midsections of members 13. The center band 16 forms the operating spring while the flanges form sleeves for receiving chopsticks.

Figure 2A:
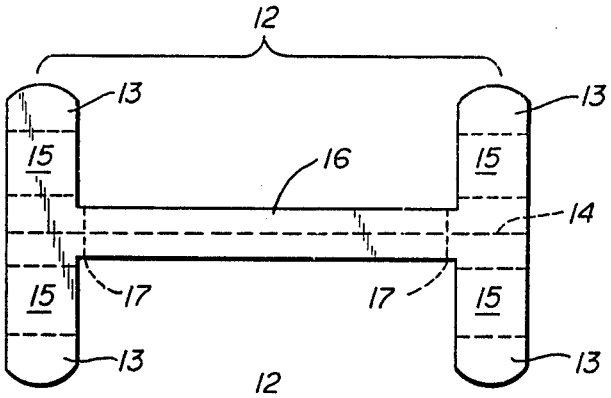
FIGS. 2A, 2B, 2C and 2D illustrate in the plan view the progressive shaping and forming of the invention from a sheet metal blank, with FIG. 2D being a side view of the invention prior to bending and curving of the band spring.
Figure 2B:
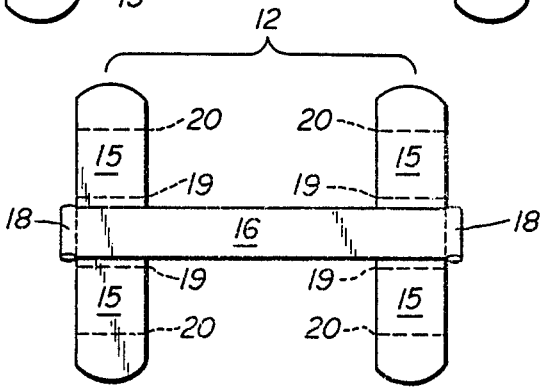
Figure 2C:
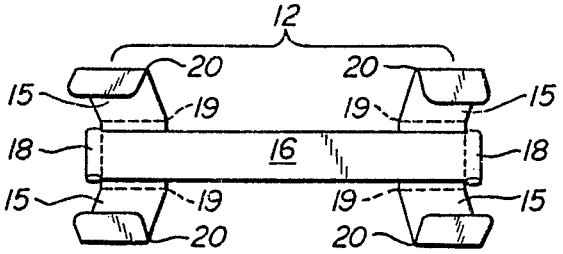
Figure 2D:
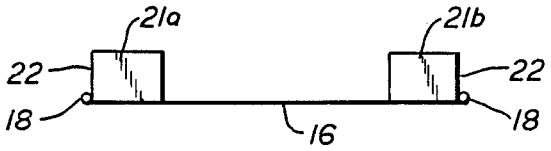

End members 13 are bent under the center band 16 at lines 17 on the band immediately adjacent to their junction with the band until their midsections overlap the ends of band 16. Referring to FIGS. 2B and 2C, this is done by forming a small, tight full loop 18 at the junction of the band and end members. The flanges 15 are then bent at right angles along lines 19 on both borders of the band so as to enclose a portion of the band and further bent toward each other in a rounded, curved manner generally along a line 20 between the right angle bend and their ends.

Figure 3:
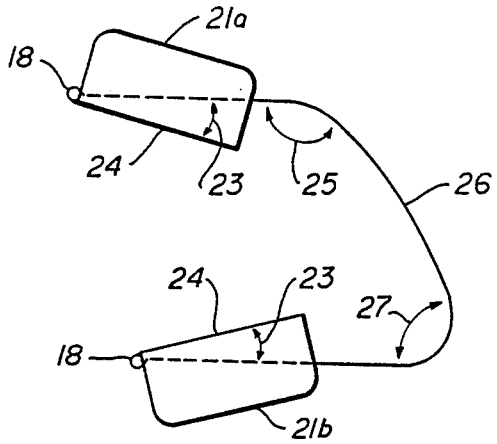
FIG. 3 is a side view of the invention.
Figure 4:
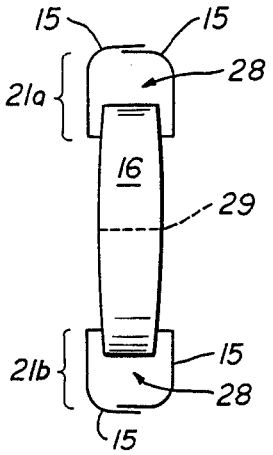
FIG. 4 is a rear perspective of the invention.
Figure 5:
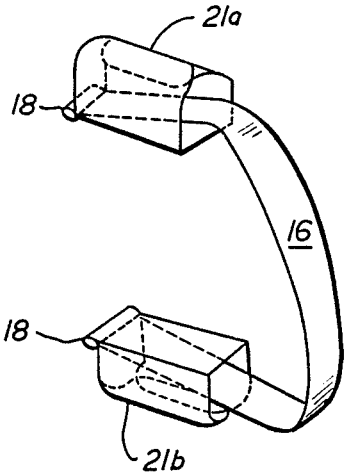
FIG. 5 is a perspective view of the invention.

Referring to FIGS. 3, 4 and 5, the two above-described bends in the flanges converge the flanges and overlap them to enclose the band spring 16 within sleeves 21*a* and 21*b* at each end of the band 16, with the band traversing through each sleeve. The terminus, as well as the origin, of the band spring 16 is the full loop 18 situated immediately adjacent to and outside of each of the sleeves adjacent their outer ends 22.

Referring to FIGS. 3 and 5, the band spring 16 is made to rise at an acute angle 23 of approximately 15° from the loops 18 through the sleeves 21*a* and 21*b*, away from the sleeve floors 24. This results in biasing the band spring 16 to contact a chopstick passed through a sleeve, generating tension and friction against the chopstick in concert with the hump of loop 18 and the constricting overlapped flanges 15, thereby securing the chopsticks within the sleeves in an automatic and effective manner.

Upon exiting from upper sleeve 21*a*, the band spring 16 is roundly bent downward near the sleeve at an obtuse angle 25 of approximately 120° and extends in a slight arc 26 for a distance and is then roundly bent at an acute angle 27 of approximately 60°. From there the spring extends for a distance to lower sleeve 21*b* and traverses through that sleeve to terminate in loop 18 in identical manner to the structure in sleeve 21*a*, including the angled rise from the loop away from the tunnel floor 24.

FIG. 4, a rear perspective of the spring and sleeves, enables a view of two aspects of the invention. One is the overlapped nature of the flanges 15 defining the sleeves 21*a* and 21*b* which are reasonably tractable, allowing them to be manually adjusted with squeezing pressure on them to contract the aperture 28 for passage of narrower chopsticks. Conversely, with thicker chopsticks, they can expand outward and adjust to the girth of the chopsticks. The other feature revealed is a graduating slight bulge 29 in the width of the connecting band 16 between the sleeves which, although not necessarily essential, is advantageous to resisting possible lateral twisting of the band.

In FIG. 5, the completed spring means including attachment means (sleeves 21*a* and 21*b*) is seen in full perspective, poised and ready to receive a pair of chopsticks.

Figure 6:
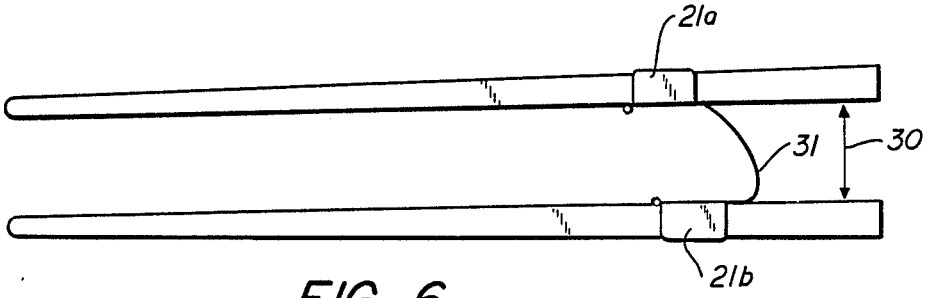
FIG. 6 is a side view of the invention; illustrating a pair of chopsticks attached in place.

FIG. 6 depicts the invention attached to a pair of chopsticks, holding them in approximately parallel relationship with the upper sleeve 21*a* disposed distinctly forward of the lower sleeve 21*b*. In this installed configuration, the distance 30 between the sticks may be expanded or contracted by gently pressing the sticks together or pulling them apart at their points of attachment, thus enabling the assembly to be adjusted for holding by hands markedly differing in size. When this is done, the lower bend 31 will invariably be modified the most, since it has the most capacity to be expanded or contracted. Also, misalignment of the chopsticks caused by the modification is correctable by moving the upper stick longitudinally into alignment with the lower member. By virtue of the unique construction of the spring means and attachment means, compression of the band spring to bring the tips of the chopsticks into contact with an object permits enough forward axial movement of the upper chopstick (the one moved toward the other, generally stationary stick) to accommodate and abet the natural movement of the implementing digits without introducing fatigue-causing restraints.

What is claimed is:

1. A device for assisting in the use of chopsticks comprising spring means, in the form of a resilient band;

attachment means comprising a chopstick receiving sleeve having a base formed at each end of said resilient band; and securing means being a pressure means within each sleeve integral therewith and in addition thereto operable to engage and apply pressure against a chopstick inserted into said sleeve.

2. The invention of claim 1 wherein said securing means is an extension of said spring means band which extends through said sleeve at an angle to said sleeve base.

3. The invention of claim 2 wherein said spring means band of resilient material forms one acute angle and one obtuse angle.

4. The invention of claim 2 wherein said spring means and said attachment means are formed from a single piece of resilient material.

5. The invention of claim 4 wherein each said sleeve comprises a pair of overlapping flanges attached to said base member.

6. The invention of claim 2 wherein said spring means band attaches to each said sleeve by a small loop.

7. The invention of claim 6 wherein said spring means including said attachment means are formed from a single piece of resilient material.

8. A method of forming a chopstick-assisting spring device comprising the steps of:

(a) forming a flat blank of resilient material in the shape of an "H" having transverse end members symmetrical about the axis of a center connecting band member wherein the midsections of said transverse end members are contiguous with said center band member;

(b) bending said center connecting band member at its juncture with each end member into a tight loop whereby the midsection of each said end member overlaps a portion of said connecting band;

(c) bending each said end member at right angles along lines parallel to and slightly spaced from said center connecting band member in a direction toward said band member; and (d) bending in overlapping relation the free ends of said end members to form expandable sleeves.

9. The method of claim 8 further comprising the steps of:

(e) bending said center band member near and outside one of said sleeves to form an obtuse angle; and (f) bending said center band member near and outside the other sleeve to form an acute angle.

10. The method of claim 9 further comprising the step of:

(g) bending said center band along transverse lines adjacent each of the loops until said center band forms an angle with the midsections of said transverse end members.

11. A chopstick-assisting device according to the method of claim 10.

* * * * *